United States Patent [19]

Petterson

[11] 4,350,272

[45] Sep. 21, 1982

[54] PRODUCT ISOLATED AEROSOL CONTAINER AND METHOD OF MANUFACTURE

[76] Inventor: Tor H. Petterson, Palos Verdes, Calif.

[21] Appl. No.: 194,015

[22] Filed: Oct. 6, 1980

Related U.S. Application Data

[63] Continuation-in-part of Ser. No. 93,037, Nov. 9, 1979, abandoned, which is a continuation of Ser. No. 620,691, Oct. 9, 1976, abandoned, which is a continuation of Ser. No. 384,700, Aug. 1, 1973, abandoned, which is a continuation-in-part of Ser. No. 180,790, Sep. 15, 1971, abandoned.

[51] Int. Cl.[3] ..... B65D 35/28; B67D 5/54

[52] U.S. Cl. ..... 222/386.5; 53/403; 53/470; 222/389

[58] Field of Search ..... 117/6; 220/63 R; 222/386, 386.5, 388, 389, 541, 396; 141/18; 53/403, 470, 473

[56] References Cited

U.S. PATENT DOCUMENTS

| | | | |
|---|---|---|---|
| 3,393,842 | 7/1968 | Bruce et al. | 222/386.5 |
| 3,471,349 | 10/1969 | Cohen et al. . | |
| 3,620,420 | 11/1971 | Normos | 222/386.5 |
| 3,878,975 | 4/1975 | Schultz | 222/389 |
| 3,945,539 | 3/1976 | Sossong | 222/386.5 |
| 3,981,418 | 9/1976 | Williamson | 222/386.5 |

FOREIGN PATENT DOCUMENTS

| | | | |
|---|---|---|---|
| 4013792 | 6/1968 | Japan | 222/389 |
| 1189450 | 4/1970 | United Kingdom . | |
| 2024334 | 1/1980 | United Kingdom | 222/389 |

*Primary Examiner*—David A. Scherbel
*Attorney, Agent, or Firm*—Lyon & Lyon

[57] ABSTRACT

A low cost barrier package having a controlled release coating is formed in place in such a manner as to be free of air entrapment, and is caused to peel therefrom to form a barrier between the product and propellant; the package is further characterized by control of deformation and permeability of the barrier.

17 Claims, 29 Drawing Figures

TENSILE/SHEAR STRENGTH

REQUIRED DURING FILLING

— — — — Integral controlled release coating
——— Unsupported bag
(a) propellant injection point

TENSILE/SHEAR STRENGTH REQUIRED AT VARIOUS

FILL LEVELS UNDER DROP TEST CONDITIONS

— — — — Integral controlled release coating
——— Unsupported bag

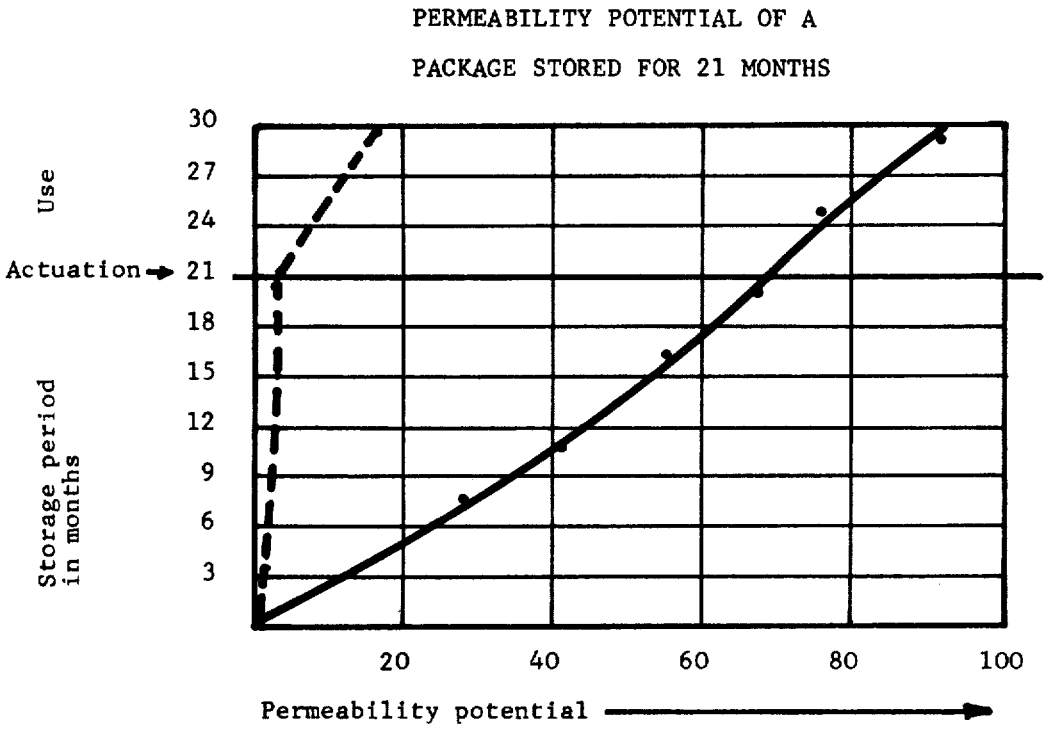
Fig.24 ------Integral controlled release coating
———Unsupported bag systems
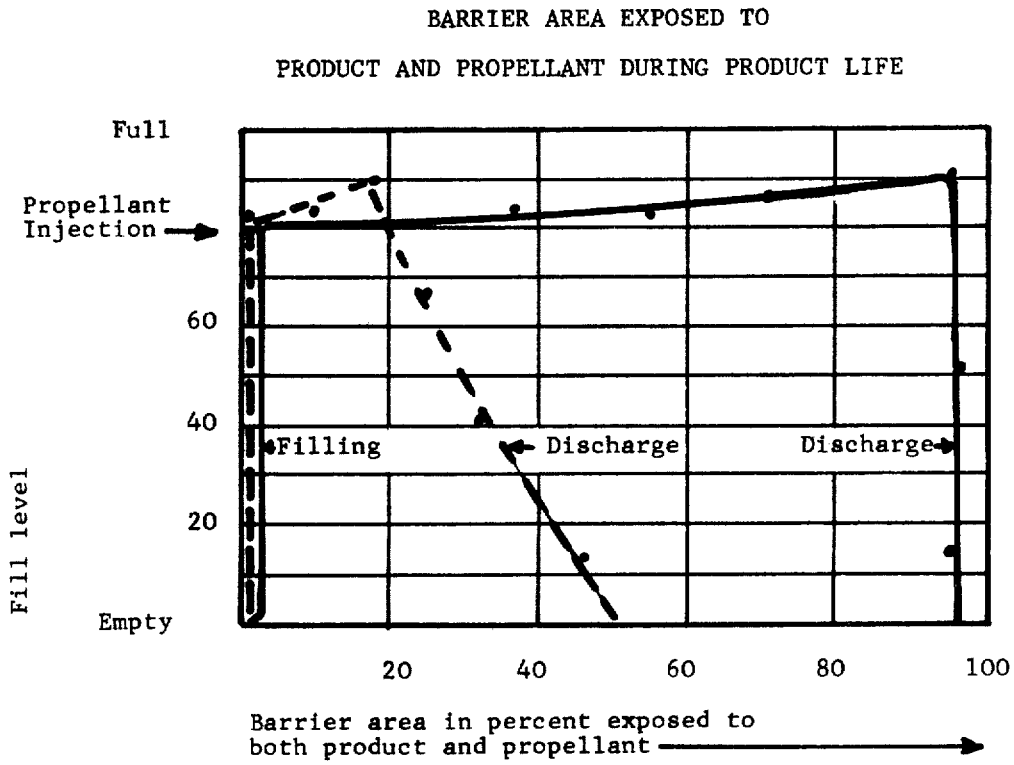
Fig.25 — — — —Integral controlled release coating
———Unsupported bag or bellows system

PRODUCT ISOLATED AEROSOL CONTAINER AND METHOD OF MANUFACTURE

CROSS-REFERENCE

This application is a continuation-in-part of patent application Ser. No. 093,037 filed Nov. 9, 1979 now abandoned; which is a continuation of patent application Ser. No. 620,691 filed Oct. 9, 1976, now abandoned; which is a continuation of application Ser. No. 384,700 filed Aug. 1, 1973; now abandoned; which is a continuation-in-part of application Ser. No. 180,790 filed Sept. 15, 1971, now abandoned; all of which four applications are incorporated herein by this reference.

BACKGROUND OF THE INVENTION

The well known aerosol dispensing package has achieved wide acceptance and success. At present, a great number of products are distributed in aerosol packages, many of the products being heretofore deemed unsuitable for aerosol dispensing. To name a few, paints, insecticides, beauty aids, powders, food products, window cleaners, etc. have all undergone revolutionary packaging changes and are now dispensed in aerosol packages. In a conventional aerosol dispensing package, a rigid tubular member, usually of metal, is partially filled with the product to be dispensed and a dispensing valve is attached to the open end of the package. Thereafter, a suitable propellant in the form of a gas is introduced into the package which exerts a force against the product tending to urge the product out of the package through the dispensing valve. Upon actuation of the dispensing valve, the force exerted by the propellant will urge the product from the aerosol package in the form of a fine mist or spray.

Since the foregoing described aerosol packages have achieved great acceptance in the consumer market and enjoys a high degree of success, increasing effort has been directed to the fabrication of packages of this type. In the matter of economics, the success of the item is diminished or even erradicated if the cost of the dispensing package is out of proportion the the cost of the product to be dispensed. That is to say, the convenience of an aerosol package may be overriden by economic considerations when, for example, a twenty-cent package is employed to dispense five cents worth of material.

Aerosol packages take many and varied forms and a primary consideration is the possible reaction between the propellant and the product to be dispensed. In many cases relating to the dispensing of non-edible products, the selection of the propellant receives little attention. However, in the packaging of volatile products, highly reactive products, edible products, etc., much attention may be directed to the selection of the propellant since reactions between the propellant and the product may oftentimes occur. This reaction results in contamination and degradation of the product and as such, is, of course, highly undersirable and to be avoided.

Accordingly, the need has arisen for a barrier package which will maintain the propellant separated from the product and a surrounding, usually rigid, container body.

One approach is by use of a piston. This has not proved satisfactory because of the possibility, during handling, of the package becoming dented. Another approach involves the use of an elastic inner container forming a barrier between the product and the pressure fluid. Two examples of this approach are U.S. Pat. Nos. 3,393,842 and 2,953,304, both of which utilize a product filled bag the rim of which is clamped between metal parts of the package. Difficulty has been encountered in insuring a complete seal as the bag may be cut during assembly.

The other examples are U.S. Pat. Nos. 3,189,321 and 3,415,425, in which the product is contained in the package above an initially compacted and folded expansible barrier containing the pressure fluid. The first of these patents indicates the need of a piston as well as the barrier, with attendant increase in package size. Another example is U.S. Pat. No. 3,549,058 wherein the metal package receives a liner having corrugated walls and a neck portion which fits into the neck of the package. While a rather complete liner is provided, difficulty is encountered in assembly as the liner neck sometimes slips into the package when the dispensing valve closure is secured. Examples of other barrier packages include U.S. Pat. Nos. 3,145,884, 3,393,842 and 3,541,581. There are other barrier systems such as shown by Sossong, Bailey and Normos. None of these references discloses controlled release coatings that are free from air entrapment.

To date, barrier packages have had but limited commercial success which can be attributed at least in part to the difficulties in manufacturing, evidenced by high package failure rates and excessive package costs.

One difficult problem inherent in barrier dispensers involves premature closure of the outlet valve by the barrier so as to prevent full evacuation of the product, that is, a portion of the barrier may be forced over the outlet opening before all of the product has been discharged so that the remaining portion of the product is entrapped.

A second problem inherent in barrier dispensers involves permeability of the barrier. The nature of the barrier materials used, the propellants used, and the products to be dispensed require extensive efforts to avoid or reduce permeability. In addition, many of these products are required to have shelf lives in excess of 24 months.

A third problem inherent in barrier dispensers involves the integrity of the barrier under various conditions including; filling and drop testing.

In view of these and other problems, there is a need for a barrier package and a method for its manufacture which result in a low cost package that is produced with a minimum of defective packages.

SUMMARY

According to the present invention, a barrier package can be manufactured easily and effectively. This is effected by first selecting a package body having first and second end walls with an intermediate wall extending between and intersecting the end walls. The first end wall has an opening for a discharge valve. Then, a selected area of the second wall is scored to form a propellant fill hole with a fill blank therein. A continuous coating of plastic material is formed in situ. The coating is adhesively and sealably bonded to at least a major portion of the intermediate wall and to all of the second end wall including the blank. The coating thus formed is free from air entrapment between the coating and the confronting wall and has a strength greater than the strength of its bond with said wall.

To put propellant in the package, the blank is displaced from the hole and the package is charged with a compressible fluid propellant through the fill hole. The bond between the coating and the confronting wall is capable of controllably releasing the coating from the second wall to form, in situ, a chamber free from air entrapment for the propellant charge while the release coating remains continuous, under tension, and contains the propellant in its compressed state.

In a preferred version of the present invention, the blank is the portion of the second wall that is scored to form the fill hole, where the blank is left in the propellant fill hole during the coating process.

In addition, preferably sealing material is placed at the intersection between intermediate wall and the second end wall in an amount sufficient to completely fill the intersection and leave no void therein.

The disposable aerosol barrier package according to the present invention comprises a package body having first and second end walls and an intermediate wall extending between and intersecting the end walls. The first end wall has an opening for a discharge valve and the second end wall has the propellant charging plug. Sufficient sealing material is at the intersection between the intermediate wall and the second end wall to completely fill the intersection with no void therein. The continuous coating of plastic material is adhesively and sealably bonded to at least a major portion of the intermediate wall and to all of the second end wall. The coating is free from air entrapment between the coating and the confronting wall and has a strength greater than the strength of its bond with the confronting wall. In addition, the coating is free from air entrapment between the coating and the sealing material. Upon charging the package with a compressible fluid propellant, the coating can be controllably released from the second end wall and the sealing material to form in situ, a chamber free from air entrapment for the propellant charge. The release coating remains continuous, under tension, and contains the propellant in the compressed state.

This method and a disposable aerosol barrier package produced by this method have significant advantages. For example, the package can be produced at minimum cost with minimum production of defective packages. In addition, the coating can be applied by various coating application techniques such as pouring the coating material into the package, then draining excess material, or by spraying material into the package.

Further advantages are that the controlled release coating can be adhered to the walls of the package with a predetermined force for the purpose of releasing additional coating having controlled deformation to insure that the dispensing valve does not become prematurally clogged by the release coating.

In addition, the barrier package can be provided with controlled deformation to insure continuous communication between the product and the dispensing valve until the maximum quantity of the product has been dispensed.

A further advantage is that a barrier package can be provided with a cost of manufacture that is essentially no greater than the cost of conventional non-barrier pressure packages. The package can be produced with manufacturing equipment presently in use and utilizing standard readily available components and raw materials.

These and other features, aspects, and advantages of the present invention will become better understood with reference to the following description, appended claims and accompanying drawings.

DESCRIPTION OF THE DRAWINGS

FIG. 24 is a chart comparing the present invention with the prior art in regard to the permeability potential of a package stored for 21 months.

FIG. 25 is a chart comparing the present invention with the prior art in regard to the barrier area exposed to product and propellant during product life.

DESCRIPTION OF THE EMBODIMENTS ILLUSTRATED

Figure 1:
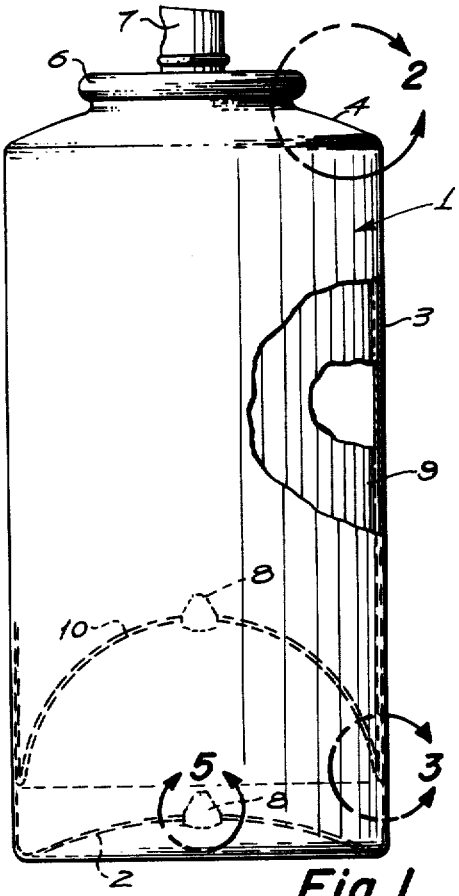
FIG. 1 is a side view with a portion in section showing one embodiment of the barrier package.
Figure 2:
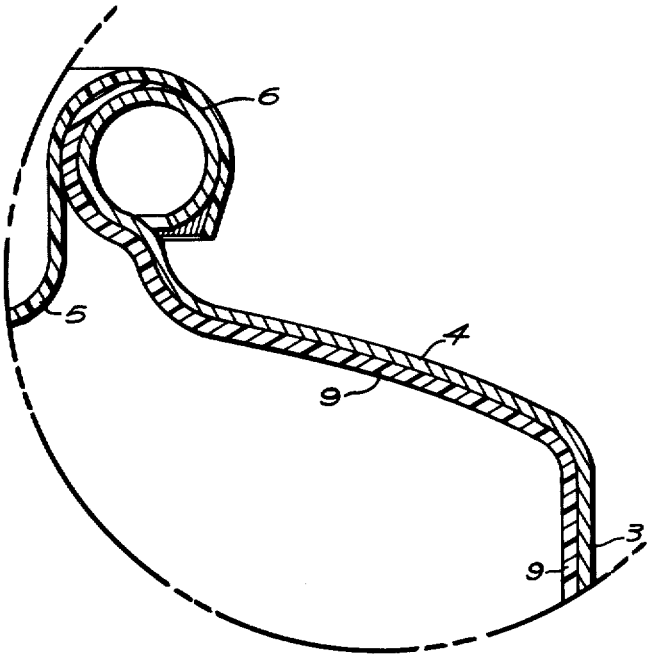
FIG. 2 is an enlarged framentary sectional view taken within circle 2 of FIG. 1.
Figure 3:
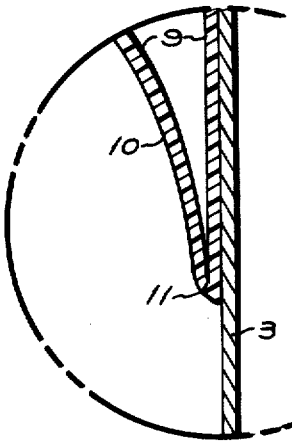
FIG. 3 is another enlarged framentary sectional view taken within circle 3 of FIG. 1.
Figure 5:
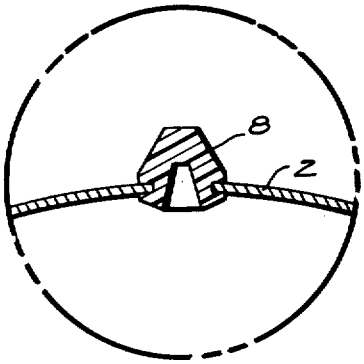
FIG. 5 is an enlarged fragmentary sectional view taken within 5—5 of FIG. 1.

Reference is first directed to FIGS. 1,2,3, and 5 which illustrates one embodiment of the barrier package. A metal container or package 1 is provided having upwardly concave bottom 2, a cylindrical side wall 3, and peripheral top wall 4. The container or package may be formed in a conventional manner by mold forming in a single piece or the bottom and top walls may be separate members and joined to the cylindrical wall in a conventional manner.

The peripheral top wall may receive a conventional closure member 5 joined hereto by conventional rolled connection 6. Mounted in the closure member 5 is a dispensing valve 7 which also may be conventional. Examples of such valves are disclosed in the following U.S. Pat. Nos. 2,615,597; 2,704,172; 2,739,841; 2,877,936; 2,906,449; 3,132,774; 2,678,147; 2,753,214; 2,772,819; 3,247,261; and 2,947,126. Fitted in the bottom wall is a conventional pressure fluid filler valve 8.

In the exercise of the present invention, the inner surfaces of the bottom wall 2, side wall 3 and peripheral top wall 4 receive formed-in-place, controlled release coating 9 which may be formed of a variety of materials. The compositions of the material may vary substantially depending upon the product to be dispensed.

The package is filled with the product to be disposed to a predetermined level which is less than full. Thereupon the closure member 5 is secured to the top wall 4. A portion of the coating could at least partially cover the top wall which receives the closure member 5 so as to be clamped therebetween within the rolled connections 6 and insure a good seal. After this is accomplished, a pressure fluid is injected through the filler valve 8. As indicated previously the filler valve may be conventional. The filler valve may be provided with a slit which may be opened by insertion of a small filler tube. After the container 1 is pressurized, the filler tube is withdrawn and the internal pressure forces the sides of the slit together so as to contain the pressure fluid. As the pressure fluid is introduced into the container or package, it releases coating 9 from a portion of the inner surface of the package. When the package is fully pressurized, a portion of the controlled release coating has released from the surface of the package to form barrier 10. It is preferred that the barrier assume a dome shape rather than merely wrinkle as it is dissipated upward by the pressure fluid and the escape of the fluid product. This condition is enhanced by so formulating the controlled release coating 9 as to be semi-adhesive so that a predetermined force is required to release the coating from the dispenser wall and in doing so produce a folded margin 11.

If desired, a semi-adhesive lamination 12 may be applied to the inner surface of the package prior to application of the controlled release coating 9. The adhesive may be weak and therefore tend to separate from itself, or its bond with either the package surface of the controlled release coating surface may be weak so as to strip therefrom. One purpose for the semi-adhesive bond between the controlled release coating and the package wall or intervening semi-adhesive is to minimize the chance that a portion of the barrier will be forced into contact with dispensing valve 7 and close the valve so that the remaining fluid product cannot be dispensed.

Figure 6:
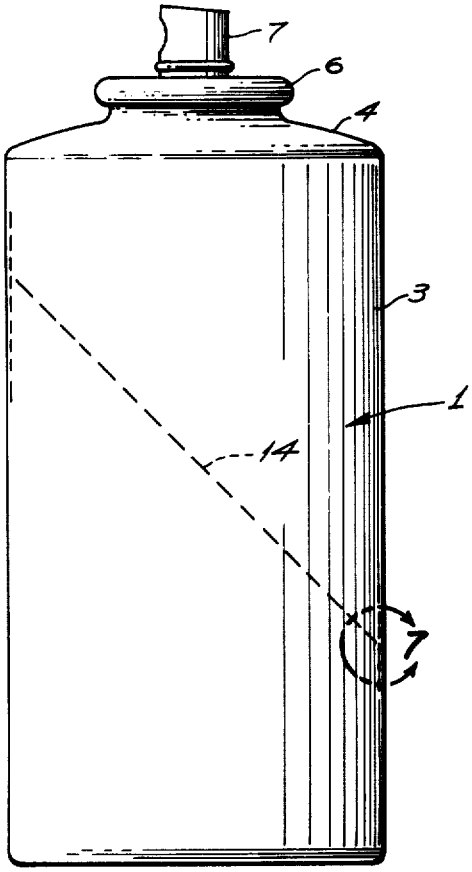
FIG. 6 is a side view showing another embodiment of barrier package.
Figure 7:
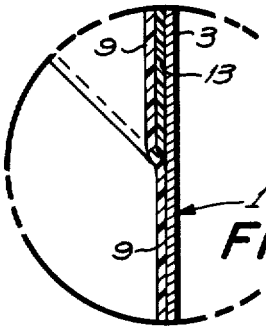
FIG. 7 is an enlarged fragmentary sectional view taken within circle 7 of FIG. 6 showing the package in its initial condition.
Figure 8:
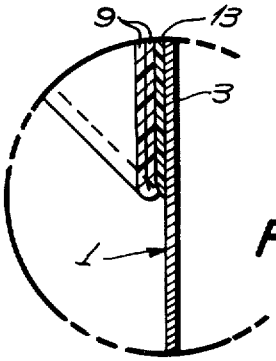
FIG. 8 is a similar enlarged fragmentary sectional view showing the package in its depleted condition.

Another approach to this problem is indicated in FIGS. 6, 7 and 8. The construction is essentially the same as that in FIGS. 1, 2 and 3 except that the upper portion of the package is provided with an adhesive lamination 13. The adhesive 13 is intended to provide a permanent bond and is disposed under that portion of the controlled release coating 9 which need not release from the inner surface of the package, that is, if the barrier portion of the controlled release coating is folded within the remaining still intact portion of the controlled release coating, the intact portion will occupy approximately one half the total internal area of the package. By applying the adhesive to essentially one half the internal area of the package in an appropriate pattern, the possibility that the barrier will prematurely close the dispensing valve can be greatly reduced. One solution is to provide an inclined boundary edge 14 as indicated in FIGS. 6, 7 and 8. This may be done by dip coating the adhesive with the package placed at an angle.

Figure 9:
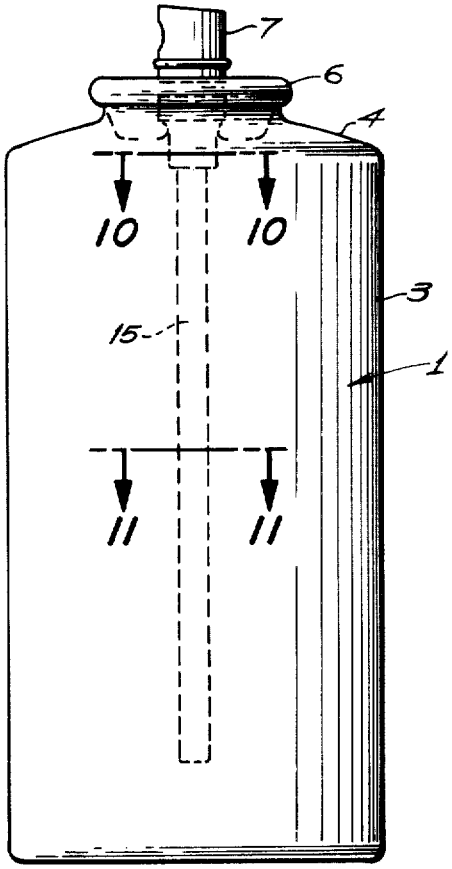
FIG. 9 is a side view of a further embodiment of the barrier package.
Figure 10:
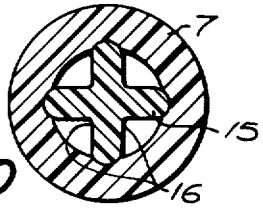
FIG. 10 is an enlarged transverse sectional view taken through 10—10 of FIG. 9.
Figure 11:
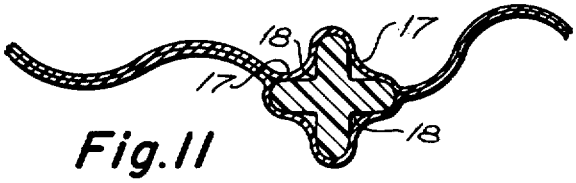
FIG. 11 is an enlarged framentary transverse sectional view taken through 11—11 of FIG. 9 showing the condition when the package is depleted.

Reference is now directed to the embodiment shown in FIGS. 9, 10 and 11. Another means of preventing premature closing of the dispensing valve 7 is to provide a stem 15 extending from the valve 7 to the bottom end of the package. The stem may be provided with longitudinally extending grooves 16 so proportioned that when the barrier collapses about the stem, as represented by 17 in FIG. 11, longitudinal passageways 18 are formed, which continue into the lower end of the dispensing valve 7 as indicated in FIG. 10.

The controlled release coating 9 is applied to the inner surface of the package in the previously described embodiments covers the entire surface of the package except for the closure member 5. Thus only the inner surface of the closure member need to be such as to be compatible to the product dispensed. That is, in the embodiments so far described the barrier and the internal surface of the controlled release coating form a product chamber, whereas the other side of the barrier and the internally exposed walls of the package form the propellant chamber.

Figure 12:
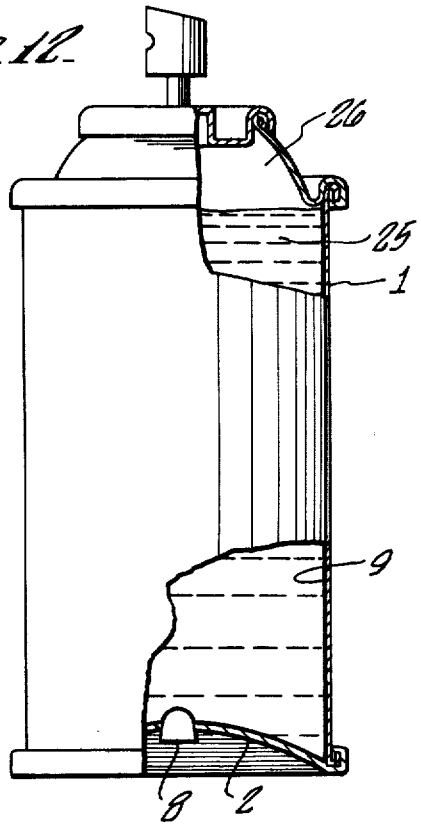
FIG. 12 is a framentary view partially in section of the barrier package as it appears when filled with product prior to propellant charge.
Figure 13:
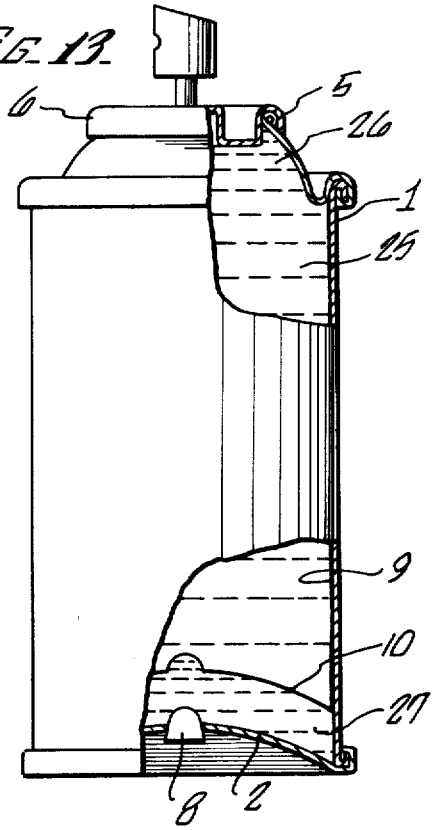
FIG. 13 is a fragmentary side view partially in section of the embodiment shown in FIG. 12 as it appears after the propellant chage.

Referring to FIG. 12, product 25 is introduced into container 1 while leaving a small area of the container 26, unfilled with product. Referring to FIG. 13, closure member 5 is secured to container 1 at 6. Thereafter liquid propellant is introduced through filler means 8 to form the liquid propellant 27, while compressing product 25 into headspace 26. At this time barrier 10 is formed and the initial controlled release of coating 9 has been affected.

Liquid propellant 27 has now defined the chamber between bottom 2 and barrier 10, and at this point is free from air entrapment and/or propellant gas.

Figure 14:
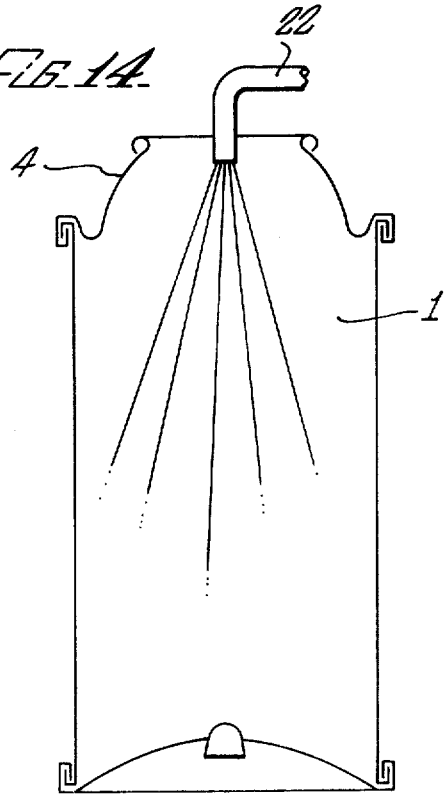
FIG. 14 is an essentially diagrammatical side view of the package in the course of receiving a liquid coating material.

The controlled release coating 9 may be introduced in several ways. A simple procedure is suggested in FIG. 14 wherein the liquid coating is merely poured into the package as from a nozzle 22. The liquid may be caused to completely fill the package. Thereupon, the package is inverted to remove the liquid material, leaving the controlled release coating. Depending upon the nature of the coating, heat may be applied to effect solidification and produce a wall of the desired thickness.

Figure 15:
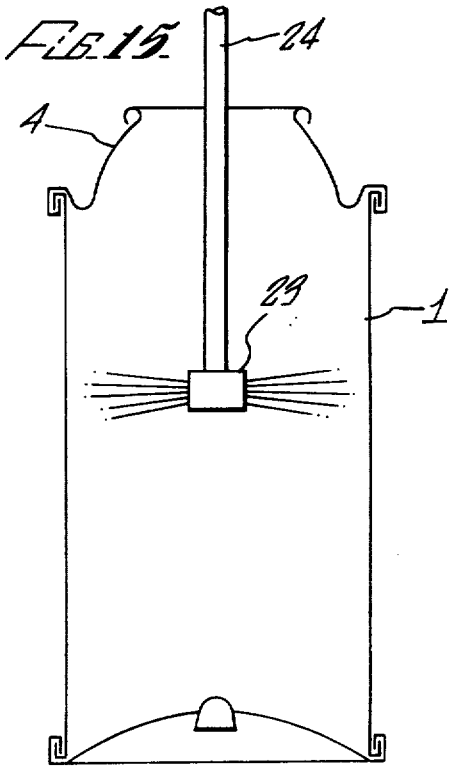
FIG. 15 is a similar side view showing a package in the course of receiving a spray supplied coating.

Another procedure as shown in FIG. 15 involves the use of a spray head 23 suspended from a stem 24 for entrance through the top wall 4. The spray head or the package 1 preferably rotates to effect a uniform coating.

Here again heat may be applied to control the thickness of the controlled release coating.

The method which forms a part of this invention centers around the step of forming-in-place a controlled release coating within the container or package free from air entrapment and then causing the controlled release coating to release progressively from the walls as the product is dispensed or as the liquid propellant is introduced into the package. The method also includes the alternative steps of filling the package with the coating material and pouring out excess material or by spray coating the controlled release coating into place.

A further method of effecting formed-in-place coating on the interior walls of the dispenser involves electrostatically charging the package and introducing the coating material in the form of fine particles. This may be accomplished by a suitable spray head inserted in the manner of the spray head 23 shown in FIG. 15, or merely directed inwardly at the mouth of the package, as the charged particles will be drawn to the surface. An even controlled release coating can be produced for the charge at any point diminishes as the coating increases.

Uniformity of the coating obtained by spraying or by pouring is enhanced by rotation of the package. Also, the package may be heated.

Suitable pressure packages of the invention comprise closed containers made of any appropriate material. For example, the package can be constructed of metal such as a conventional three-piece, tin-free steel aerosol package with a welded or soldered side seam, or one-piece drawn steel or aluminum package or a plastic package such as an injection molded copolymer of trioxane such as Celcon, or an injection blow molded acrylonitrile such as Barex, or an injection molded polyesters such as Valox. The package can be of many sizes and/or irregular shapes particularly the plastic packages. The invention is particularly useful for manufacturing irregularly shaped plastic barrier packages which are essentially non-permeable.

Liquid propellants useful in the present invention are volatile organic compounds or materials, of which may exist in the form of a gas at ordinary temperatures and pressures. They can liquefy at lower temperatures or when under pressure in a package such as those described and claimed herein. Included among suitable propellants are aliphatic hydrocarbons, partially or wholly fluorinated and partially or wholly chlorofluorinated hydrocarbons which have vapor pressures ranging from about 5 to about 100 p.s.i.g. preferbly 20 to 50 p.s.i.g. at about 70° F. Either a single compound or a mixture of two or more components can be used. And other homologs individually having vapor pressures outside the desired ranges set forth, can be used with other homologs, if the combined vapor pressure falls within such desired ranges.

Representative propellants are: aliphatic hydrocarbons, preferably saturated hydrocarbons, such as propane, butane, isobutane and cyclobutane; saturated fluorinated, and fluorinated and chlorinated, aliphatic hydrocarbons illustrated by: 1,1-difluoroethane; 1,2dichloro-1,1,2,2,-tetrachloroethane; trichlorotri-fluoroethane; dichlorodifluoromethane; monochlorodifluoromethane; monofluoromonochloromethane; 1-monochlorodifluoro-methane; monofluoromonochloromethane; 1-monofluoro-1,1-difluoroethane; trifluoro ethyl chloride; and octafluorocyclobutane.

Regardless of which of the particular compounds or mixtures thereof are employed herein as propellants, it is not necessary to be concerned about the effect of the propellant on the physical or chemical properties of the dispensable product or their effect upon the surface or area to which the product is applied. This follows from the fact that the propellant or propellants are completely isolated in the propellant section of the package, and that they do not come into contact with the product to be dispensed. Accordingly, in a pressurized package or container of a shaving preparation manufactured in keeping with this invention, those compounds set forth above as propellants which cause a tingling sensation to the skin or instability of lather can be employed as propellants since they are completely isolated from the dispensable product.

The controlled release coating of the invention is formed-in-place, free from air entrapment, integral with the inner surface of the package. The coating is obtained using various application techniques, including:

a. Conventional hand techniques such as brush, roller, air and airless spray, b. various spray applications such as electrostatic and flame sprays, c. machine applications such as roller, knife and blade curtain, air knife and strip and coil coating, d. electrodeposition including anodic and cathodic process, e. powder coating including fluidized bed and electrostatic spray, f. non-aqueous dispersion coating, and g. hot melts and high energy curing including gamma ray, electron beam, ultraviolet, infrared, microwave, and induction heating.

The raw materials for controlled release coating include:

a. Resins such as: vinyl acetate, homo and copolymers with ethylene, acrylates, dibutyl maleates, fumarates, polyvinyl formal and polyvinyl butyral, acrylic styrene, styrene-butadiene, polyvinyl chloride, alkyd polyesters, urethane, epoxy, polyamide, amino and phenolic, and b. polymers such as: vinylidene chloride, olefin polymers and copypolymers, polyethylene, polypropylene, ethylene copolymers, polybutadiene, polymides, polyester-imides and various rubbers.

In a preferred embodiment of the invention the controlled release coating is a laminate of various polymers and/or resins, and mixtures thereof which provide optimum release properties with maximum strength and optimum barrier properties specifically low permeability.

The integrity, release and low permeability properties of the controlled release coatins can be further modified by the addition of various secondary binder components such as plasticizers, rheology control agents, driers, surfactants, heat stabilizers, crosslinking agents, pigments, extenders and fillers.

Solvents for the controlled release coatings include: aliphatics, aromatics, esters, ketones, and alcohols. Non-aqueous dispersions which use less organic solvent then solution coatings can be used.

Water based and solventless coatings are particularly attractive where pollution control is desired. Examples of the latter include: radiation cured one component fluids, two component liquid systems such as epoxies polyamides and powder coatings.

Controlled release coatings of the invention are characterized by a chemical/mechanical bond with the inner surface of the package. In a preferred embodiment, this bond is free from air entrapment. The bond obtained is a function of the adhesive properties of the coating material and the nature of the inner surface of the package. For example, various portions of the inner surface can be pretreated with bond modifiers so as to selectively control the coating/inner surface bond. (See FIG. 3). Similarly, the coating can be constructed of laminates with that layer of the laminate that is in contact with the package inner surface having optimum bonding properties that compliment the inner surface pretreatment in order to obtain the desired release. (See FIG. 4).

Figure 4:
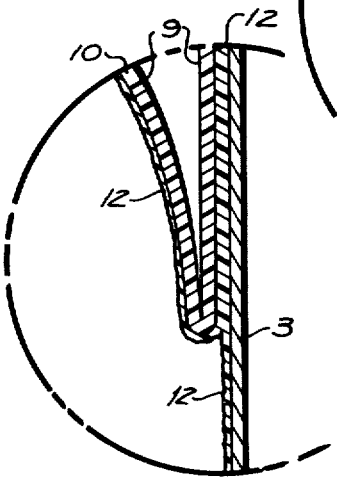
FIG. 4 is an enlarged framentary sectional view similar to FIG. 3 showing a modified construction.

Thus portions of the controlled release coating can be released with a minimal change in pressure such as shown in FIG. 4, while other portions of the coating remain integral with the inner surface irrespective of the change in pressure up to the total exhaustion of the contents of the package. (See FIG. 7).

The potential for permeability of either propellant, product or product components across the barrier is unexpectedly reduced with the controlled release coatings of the invention. The barrier which is formed with introduction of propellant comprises a small portion of the total surface area of the controlled release coating. This portion of the barrier is subjected to the severest permeability demands of any part of the controlled release coating since it is exposed to propellant longer than the remainder of the barrier formed when the product is dispensed. This initial barrier area, that is, that portion of the controlled release coating which is released from the package inner surface, upon the introduction of liquid propellant, can be further modified during the coating process to obtain improved anti-permeability properties. The anti-permeability control means which can be used include various additional layers of coating materials such as polyvinylchloride, polyimides, polyamides, polyesters, metallic films and the like and various combinations thereof. In a preferred embodiment of the invention the anti-permeability control means comprises a semi-rigid laminate of a coating material such as polyvinylchloride and an electrodeposited metal.

The heretofore unobvious advantages of the invention such as controlled release coatings and permeability control are particularly important to plastic barrier packages. That is, permeability of plastic package per se, has been one of the primary restrictions in the commercialization of plastic aerosol packaging. Additionally, the exposure of the entire plastic package to a constant pressure has resulted in many long term shortcomings of plastic aerosols including those problems related to cold flow-creep, and physical changes in structure and the like. The use of controlled release coatings in combination with initial barrier formation to define a limited area for propellant containment is particularly useful in plastic aerosol packages. Since the techniques employed to reduce permeability of the initial barrier can also be used to reduce the permeability of the plastic package in the area defining the propellant prior to dispensing. Additionally, the controlled release coatings of the invention offer substantial advantages to plastic aerosol packages in overall permeability performance.

In the preferred embodiment of the invention, the barrier is not defined during filling of the product. That is the controlled release coating is integral with essentially the entire inner surface of the package wall including the bottom wall 2 and free from air entrapment. This is particularly critical to those embodiments of the invention which are useful in high speed under-the-cap filling methods, such as described in U.S. Pat. No. 2,947,626. Since there is no space between the coating and the inner surface of the package, the high pressures used to introduce product during filling will not rupture the coating of the invention which can occur with systems, characterized by bags or other means which are not integral with the package wall and have air entrapped between the inner surface of the package and the bag.

Figure 22:
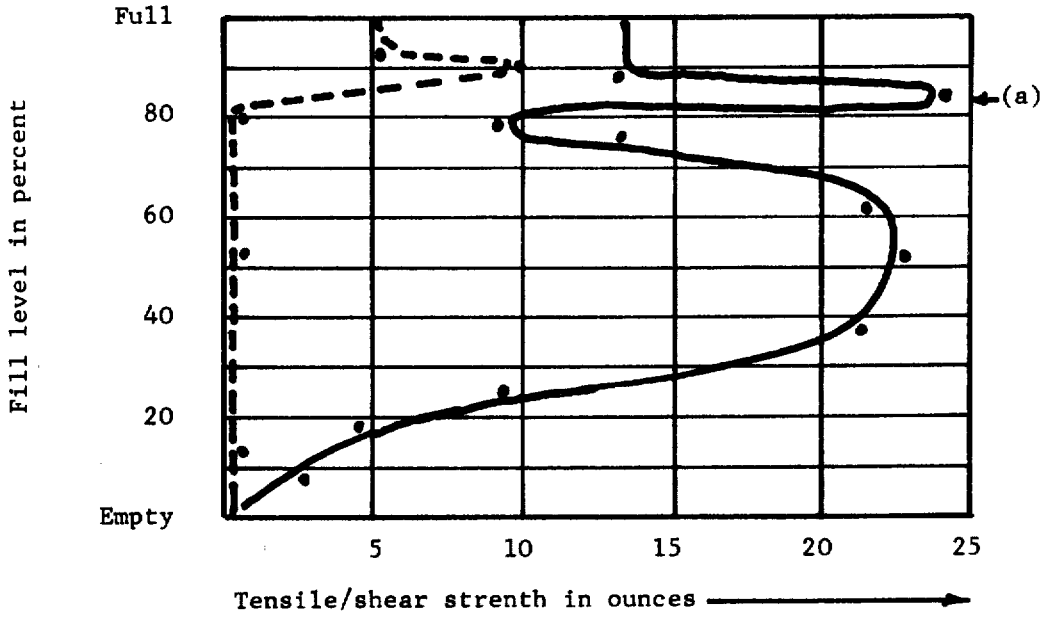
FIG. 22 is a chart comparing the present invention with the prior art in regard to the tensile/shear strength required during filling.

Reference is made to FIG. 22 which is a chart illustrating the advantages of the present invention which are obtained during filling of the package with a food toping at about 120 to 180 p.s.i.g. That is, a formed-in-place, controlled release, polyester modified coating of the invention which is integral with the dispenser inner surface and free from air entrapment requires a maximum tensile shear/shear strength of about 10 oz. at approximately the 90% fill level. In contrast, a bag barrier which is supported at the valve cup requires a tensile/shear strength over 20 oz. at about the 40% fill level and again at about the 80% fill level.

After the package is filled and the dispensing valve secured to the package, the barrier is defined by introducing the liquid propellant through propellant filling means 8. Such methods of introducing propellant are described in detail in Drug and Cosmetic Industry, August, 1967, and Canadian Patent No. 751,725. At this time a portion of the controlled release coating releases from the package inner surface to define a container for the liquid propellant. (See FIGS. 3 or 4). Upon actuation of the dispensing valve a pressure increase is created across the barrier 12, the barrier being defined as that portion of the controlled release coating which is no longer integral with the package inner surface. The controlled release coating responds to this pressure increase by releasing from the inner surface of the package to the expent necessary so that there is substantially no pressure differential across the barrier. (See FIG. 8).

In another embodiment of the invention deformation of the barrier is controlled by the combination of the controlled release properties of the coating and the physical properties of the barrier, its elastomeric properties, and the inclusion of preferential deformation means such as the various ribs and the like.

Figure 23:
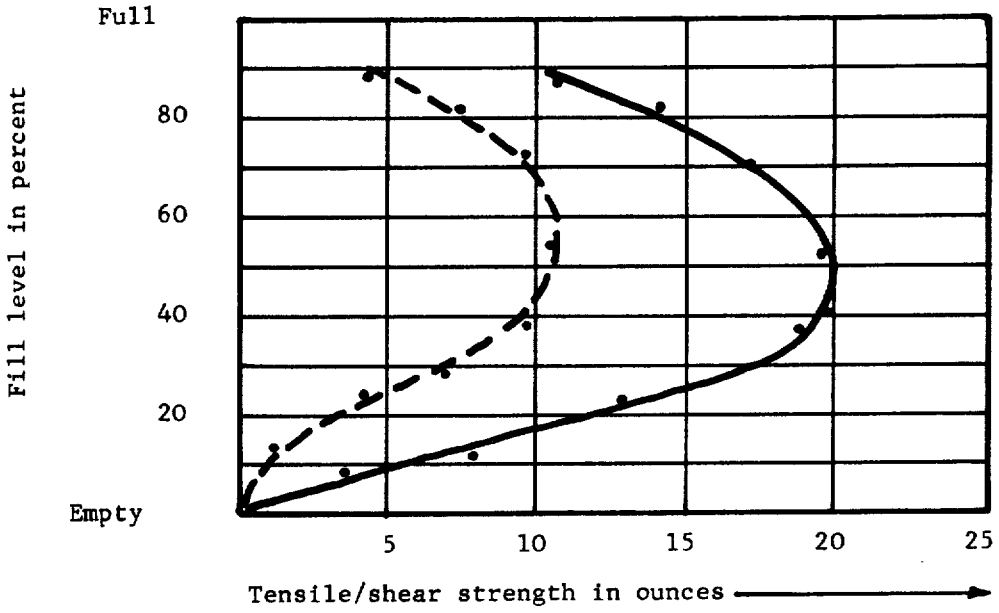
FIG. 23 is a chart comparing the present invention with the prior art in regard to the tensile/shear strength required at various fill levels under drop test conditions.

Reference is directed to FIG. 23 which is a chart illustrating the tensile/shear strength required at various fill levels under drop test conditions. This chart illustrates the unobvious advantages of the present invention which are obtained when a package constructed in accordance with the invention is drop tested at 10 g. That is, when a 7 oz. barrier package having a modified polyester controlled coating is filled with a tooth paste to various levels, charged with a liquid hydrocarbon propellant and drop tested, the tensile/shear strength requirements of the integral coating of the present invention were slightly greater than 10 oz. at 60% fill level. In contrast, a bag barrier package in which the barrier is supported at the valve cup and filled with the same product and charged with the same propellant required a tensile/shear strength of over 20 oz. at the 60% fill level.

Reference is now directed to FIG. 24 which is a chart illustrating the advantages in anti-permeability obtained with a barrier package of the present invention. That is, the potential for permeability occurring across the barrier is dramatically reduced in the controlled released coating of the invention. Until the package is actuated and a product dispensed approximately 9% of the controlled release coating has been released to form the barrier and contain the liquid propellant. This portion of the controlled release coating could be further modified to control permeability. In contrast, a bag barrier package which is supported at the valve cup has up to 98% of the bag liner exposed to product and propellant prior to the first actuation. When the permeability potential of these two barrier packages are plotted over the average shelf life of a package (21 months) and during an average use period of three months, the advantages in reduced permeability potential of the invention is illustrated in FIG. 23.

FIG. 25 is a chart which illustrates the barrier area exposed to product and propellant during product life by use of the present invention in comparison to use of an unsupported bag or bellows system. More particularly, the percent of polyester modified coating released to form a barrier at various percentages of product dispensed is copared with an unsupported bag. In both cases the product was dispensed from a seven ounce aerosol package filled with fluoride containing tooth paste and charged with a blend of fluorinated hydrocarbon propellants.

The barrier packages of the present invention are particularly suitable for dispensing flowable materials such as liquids, pulps, pastes, powders and the like, including products such as food stuffs, cosmetics, pharmaceuticals, toothpastes, mouth wash, shaving cream, shampoo, antiperspirant, caulking compounds, adhesives and the like.

It has further been observed that if entrapped air bubbles are present during the coating of the container, and these bubbles are allowed to remain, after the coating has dried they tend to create potential points of weakness in the barrier. These bubble areas oftentimes produce barrier failure during dispensing of the product. This failure is characterized by rupture of the barrier.

Figure 16:
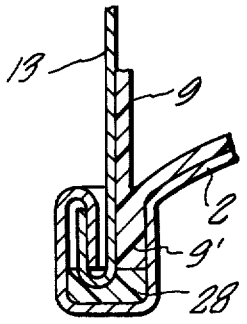
FIGS. 16 thru 20 are enlarged fragmentary sectional views of the area defined by the juncture of sidewall 13 and bottom wall 2 illustrating various means for minimizing air entrapment and barrier failure.

For example, referring to FIG. 16, when conventional three piece containers are coated with the barrier materials, the internal area of the container defined by the intersection of the sidewall 3 and the bottom 2 and gasket 28 is susceptible to bubble formation and air entrapment during the coating procedure. This is indicated as 9'. When precautions are not taken to avoid this condition a high incidence of barrier failure generally results in the barrier in this area. This barrier failure is attributed to rupturing of the film due to pin holeing in the area of 9'.

In order to minimize air entrapment during coating, it is important that any void between the bottom and side walls of the can in the seam area be completely filled. Generally, in prior art cans, gasket material only in an amount sufficient to prevent leakage at the seam was used. According to the present invention, sufficient sealing material such as gasket material is provided that a continuous air free interface is formed between the sealing material and the coating. This permits the controlled release coating to easily release without being trapped in the seam area.

Increasing the amount of sealing material so that a continuous air free interface is formed between the sealing material and the coating material has decreased failure of the coating to release from about 60% of production to less than 1% of production. For a 3 inch diameter can, this improvement was realized by increasing the amount of gasket material from about 0.05 gram to about 0.10 gram.

The sealing material needs to be flexible after it is applied, and sufficiently fluid during application to completely fill the void between the bottom and side walls of a can. Suitable sealing materals are conventional gasket materials such as polyurethanes, silicones, polyvinychloride resins, and Buna-S rubber.

Figure 17:
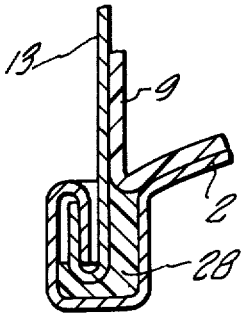
Figure 18:
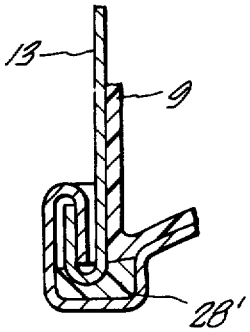
Figure 19:
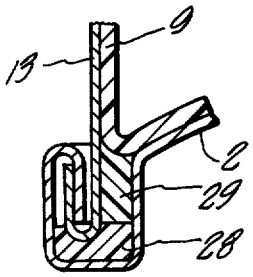

Referring to FIGS. 17 through 19, special steps can be taken during container manufacture to modify the seaming process at the bottom of the container in order to minimize air entrapment during coating. For example, the seaming process can be modified so as to fill the void in the seam area with sealing material such as excess gasket material shown in 28' in FIGS. 17 and 18. Alternatively, the void area can be filled with sealing material such as a preliner flow coating 29 as shown in FIG. 19. This coating is introduced prior to forming barrier coating 9. The preliner flow coating is specifically formulated to wet out and fill the void area.

Figure 20:
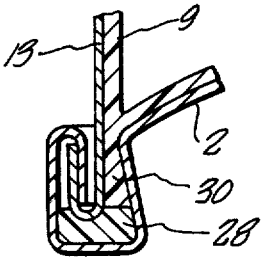

The excess gasketing agent 28+ not only excludes air from entrapment, it also obviates the forming of a "pinched barrier" condition 30 as shown in FIG. 20.

Figure 21:
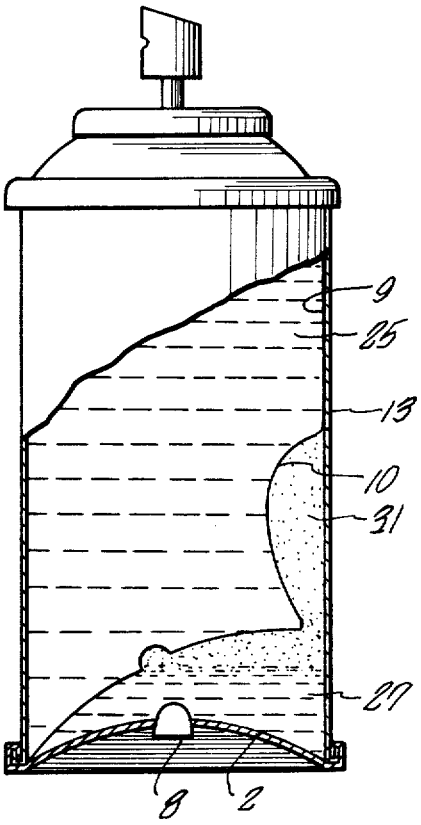
FIG. 21 is a side view with a portion in section showing a barrier condition resulting from air entrapment.

It has further been observed that if air is allowed to be entrapped in the area between the container wall and the coating 9 and barrier rupturing does not occur a second problem is presented, especially during shipping and/or vibration. This problem is illustrated in FIG. 21 and is described as a premature release of the coating 9, the forming of liner 10 in a mode which is not responsive to product discharge as illustrated in FIG. 1. Specifically, entrapped air 31 produces a release of coating 9 from sidewall 3 to form liner 10 above propellant 27. It is thought this condition is caused primarily by the specific gravity differential of liquid propellant versus gas/versus weight of product 25.

It is believed that when premature controlled release occurs there is a dramatic increase in permeability potential as the gas/air tends to migrate towards the top of the container. This migration phenomenon is more apt to occur during vibration and/or shipping than under static conditions.

FIGS. 26 through 29 illustrate novel means for preparing a container for a propellant charge and charging the barrier package with the propellant material.

Figure 26:
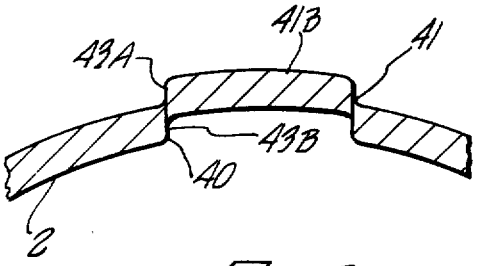
FIGS. 26 thru 29 are enlarged fragmentary section views of the base of the container in the area of the propellant charging port—showing the charging port pore scored/blanked with the liner applied, under propellant charge and with the closure plug in place.

With reference to FIG. 26, the uncoated container base 2 is scored at 40, providing a propellant fill hole 40A with a blank 43 therein. Preferably, the scoring is done from the outside, leaving about 10% of the blank 43 in contact with the side wall of the hole 40A. In other words, at least 10%, preferably from about 15–20% of the surface area of the circumferential side wall 43A of the blank 43 is in contact with the circumferential side wall 43B of the fill hole 40A. This can be effected by use of a conventional die with a spring therein for pushing back the blank 43 into the fill hole 40A, as shown in FIG. 27.

Figure 27:
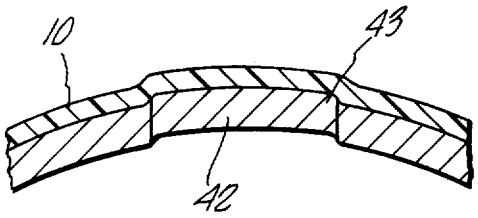
Figure 29:
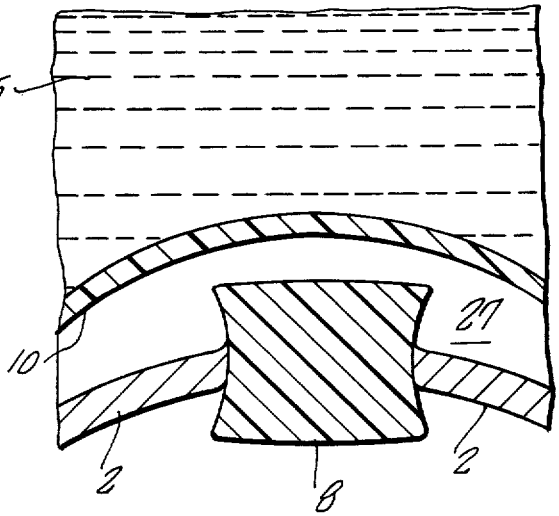

Then as shown in FIG. 27, a release coating 9 is applied over the base 2 including the blank 43.

Figure 28:
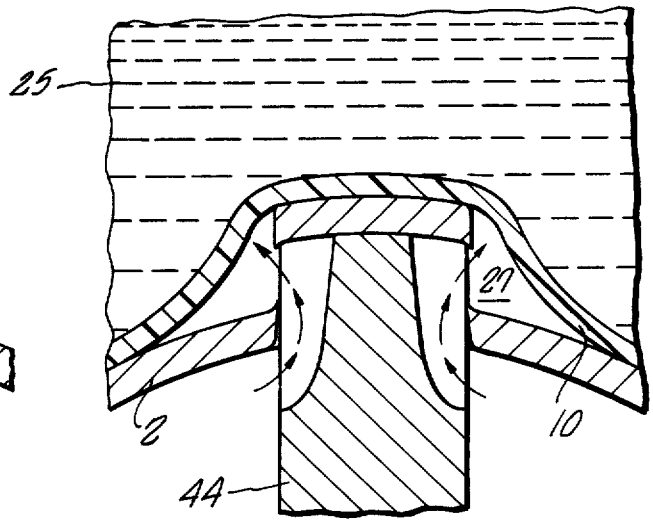

Subsequently, as shown in FIG. 28, for a container filled with product 25, a mechanical ram 44 is used to force the blank 43 into the container while propellant 27 is introduced into the chamber defined between the container and the barrier 10. Then, a closure plug 8 is positioned in the propellant fill hole 40A resulting from release of the blank 43 from the bottom 2.

The partial scoring described above in combination with the container bottom is such that the integrity of the container is retained. Thus, when the barrier coating is applied to the container bottom there is no air entrapment. This is evident when the blank is removed or in propellant charging and the barrier is formed, because there is no barrier failure in the area of the propellant fill hole through the air entrapment.

While particular embodiments of this invention have been shown and described, it is not intended to limit the same to the details of the construction set forth, but instead, the invention embraces such changes, modifications and equivalents of the various parts and their relationships as come within the pursue of the appended claims.

What is claimed is:

1. A disposable aerosol barrier package containing a. a package body having first and second end walls and an intermediate wall extending between and intersecting said end walls, wherein said first end wall has an opening for a discharge valve and said second end wall has a propellant charging plug;

b. sufficient sealing material at the intersection between the intermediate wall and the second end wall to completely fill the intersection and leave no void therein; and c. a continuous coating of plastic material formed in situ and adhesively and sealingly bonded to at least a major portion of said intermediate wall and to all of said second wall wherein:

(1) said coating is free from air entrapment between the coating and the confronting wall and has a strength greater than the strength of its bond with said wall, (2) said coating is free from air entrapment between the coating and the sealing material, and (3) upon charging the package with a compressible fluid propellant said coating can controllably release from said second wall and said sealing material to form, in situ, a chamber, free from air entrapment, for the propellant charge while the coating remains continuous, under tension and contains the propellant in a compressed state.

2. A disposable aerol barrier package containing a product and a separate propellant charge free from entrapped air comprising:

a. a package body including first and second end walls and an intermediate wall extending between and intersecting said end walls, a product discharge valve in said first end wall and a propellant charging plug in said second end wall;

b. sufficient sealing material at the intersection between the intermediate wall and the second end wall to completely fill the intersection and leave no void therein;

c. a continuous coating of plastic material formed in situ and adhesively and sealingly bonded initially to at least a major portion of said intermediate wall and to all of said second wall, said coating and confronting wall being free from air entrapment there-between and said coating having a strength greater than the strength of its bond with said walls, and said coating being free from air entrapment between the coating and the sealing material;

d. a compressed charge of propellant having, at atmospheric pressure, a volume exceeding the package body, said propellant charge being interposed between the coating, said second wall and adjacent portion of said intermediate wall;

e. a fluid product occupying the remainder of the package body;

f. said coating forming a barrier between the propellant and the product, the periphery of said barrier being bonded to the intermediate wall;

g. said barrier, upon releasing a portion of the product, being subject to corresponding expansion of the propellant, and attendant peeling of its periphery from the intermediate wall and said sealing material.

3. A package as defined in claim 1 or 2 wherein at least that portion of the coating over said second end wall initially exposed to propellant is treated to be substantially non-permeable to said propellant.

4. A package as defined in claim 1 or 2 wherein at least a portion of the coating is a laminate.

5. A package as defined in claim 1 or 2 wherein the area of said barrier remains less than about 50% of the area of said coating.

6. A package as defined in claim 1 or 2 wherein said barrier is dome-shaped and provided with means to minimize permeability.

7. A package as defined in claim 1 or 2 wherein said coating upon progressively releasing folds upon itself such that the initial barrier remains the principal area exposed to product and propellant.

8. A package as defined in claim 1 or 2 wherein said barrier is a laminate.

9. A package as defined in claim 1 or 2 wherein the area of said barrier remains less than about 50% of the area of said coating.

10. A package as defined in claim 1 or 2 wherein the area of the initial barrier increases less than about 100% upon total discharge of the product.

11. A method for forming a disposable aerosol package comprising steps of:

(a) selecting a package body having first and second end walls and an intermediate wall extending between and intersecting the end walls, wherein the first end wall has an opening for a discharge valve;

(b) scoring a selected area of the second end wall to form in the second end wall a propellant fill hole with a blank therein;

(c) forming in situ a continuous release coating of plastic material that is adhesively and sealably bonded to at least a major portion of the intermediate wall and to all of the second end wall including the blank, wherein;

(1) the coating is free from air entrapment between the coating and the confronting wall and has a strength greater than the strength of its bond within the wall; and (2) the coating is free from air entrapment in the area of the blank;

(d) displacing the blank from the propellant fill hole and charging the package with a compressible fluid propellant through the propellant fill hole, wherein the coating can controllably release from the second wall to form a chamber free from air entrapment for the propellant charge where the release coating remains continuous, under tension and contains the propellant in a compressed state; and (e) placing a plug in the propellant fill hole.

12. The method of claim 11 in which the plug is flexible.

13. The method of claim 11 in which the blank is a portion of the second wall that is scored to form the fill hole.

14. The method of claim 13 in which the step of scoring comprises leaving the blank in the hole so that at least 10% of the surface area of the circumferential side wall of the blank is in contact with the circumferential side wall of the fill hole.

15. The method of claim 11 including, before the step of forming the coating, providing sufficient sealing material at the intersection between the intermediate wall and the second end wall to completely fill the intersection and leave no void therein.

16. The method of claim 15 in which the step of forming a coating comprises forming a coating that is free from air entrapment between it and the sealing material.

17. A method for forming a disposable aerosol package comprising steps of:

(a) selecting a package body having first and second end walls and an intermediate wall extending between and intersecting the end walls, wherein the first end wall has an opening for a discharge valve;

(b) scoring a selected area of the second end wall to form in the second end wall a propellant fill hole with a blank therein;

(c) providing sufficient sealing material at the intersection between the intermediate wall and the second end wall to completely fill the intersection and leave no void therein;

(d) forming in situ a continuous release coating of plastic material that is adhesively and sealably bonded to at least a major portion of the intermediate wall and to all of the second end wall including the blank, wherein;

(1) the coating is free from air entrapment between the coating and the confronting wall and has a strength greater than the strength of its bond with the wall;

(2) the coating is free from air entrapment between the coating and the sealing material; and (3) the coating is free from air entrapment in the area of the blank;

(e) displacing the blank from the propellant fill hole and charging the package with a compressible fluid propellant through the propellant fill hole, wherein the coating can controllably release from the second wall and the sealing material to form a chamber free from air entrapment for the propellant charge where the release coating remains continuous, under tension and contains the propellant in a compressed state; and (f) placing a plug in the propellant fill hole.

* * * * *